US009851090B2

(12) United States Patent
Scribante et al.

(10) Patent No.: US 9,851,090 B2
(45) Date of Patent: Dec. 26, 2017

(54) SYSTEMS AND METHODS FOR HIGH BAY LIGHT FIXTURES

(71) Applicant: Orion Energy Systems, Inc., Manitowoc, WI (US)

(72) Inventors: John H. Scribante, Manitowoc, WI (US); Scott Green, Ponte Vedra Beach, FL (US); Matthew S. Tlachac, Manitowoc, WI (US); Joseph Bluma, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 8 days.

(21) Appl. No.: 15/277,389

(22) Filed: Sep. 27, 2016

(65) Prior Publication Data

US 2017/0097152 A1 Apr. 6, 2017

Related U.S. Application Data

(60) Provisional application No. 62/236,022, filed on Oct. 1, 2015.

(51) Int. Cl.

| | |
|---|---|
| ***F21V 7/20*** | (2006.01) |
| ***F21V 29/83*** | (2015.01) |
| ***F21V 7/00*** | (2006.01) |
| ***F21K 9/278*** | (2016.01) |
| ***F21V 23/06*** | (2006.01) |
| ***F21V 23/00*** | (2015.01) |
| ***F21K 9/275*** | (2016.01) |
| *F21Y 115/10* | (2016.01) |
| *F21Y 103/10* | (2016.01) |

(52) U.S. Cl.
CPC ..... *F21V 29/83* (2015.01); *F21K 9/275* (2016.08); *F21K 9/278* (2016.08); *F21V 7/0083* (2013.01); *F21V 23/003* (2013.01); *F21V 23/06* (2013.01); *F21Y 2103/10* (2016.08); *F21Y 2115/10* (2016.08)

(58) Field of Classification Search
CPC ..... F21K 9/275; F21K 9/278; F21V 23/003; F21V 23/06; F21V 29/83; F21V 7/0083; F21Y 2103/10; F21Y 2115/10
USPC ..... 362/217.05, 247, 249.02, 296.05, 346
See application file for complete search history.

(56) References Cited

U.S. PATENT DOCUMENTS 5,823,663 A * 10/1998 Bell ..... F21S 8/02 362/260
7,837,347 B2 * 11/2010 Warner ..... F21V 7/0016 362/217.03

(Continued)

*Primary Examiner* — Tsion Tumebo
(74) *Attorney, Agent, or Firm* — Foley & Lardner LLP

(57) ABSTRACT

A light fixture includes an enclosure having a top side and an opposing underside, and a luminaire module. The luminaire module includes a panel, a plurality of LEDs, a first reflector, and a second reflector. The panel extends along the opposing underside of the enclosure. The plurality of LEDs are coupled to the panel and arranged in at least one row. The at least one row has a first lateral side and a second lateral side. The first reflector is coupled to the panel and disposed along the first lateral side of the plurality of LEDs. The second reflector are coupled to the panel and disposed along the second lateral side of the plurality of LEDs. The panel is releasably attached to the enclosure such that replacement of the panel simultaneously replaces the plurality of LEDs, the first reflector, and the second reflector.

4 Claims, 13 Drawing Sheets

(56) References Cited

U.S. PATENT DOCUMENTS

| | | | | |
|---|---|---|---|---|
| 7,896,514 | B2 * | 3/2011 | Gomi | G02F 1/133605 362/612 |
| 7,901,105 | B2 * | 3/2011 | Fowler, Jr. | F21V 3/04 362/217.15 |
| 8,096,679 | B2 * | 1/2012 | Chen | F21V 7/0083 362/241 |
| 8,272,763 | B1 * | 9/2012 | Chinnam | F21V 29/004 362/147 |
| 8,727,566 | B1 * | 5/2014 | Szeto | F21S 8/026 29/825 |
| 9,016,892 | B1 * | 4/2015 | Scribante | F21V 29/763 362/222 |
| 9,322,518 | B1 * | 4/2016 | Steedly | F21S 8/026 |
| 2009/0034263 | A1 * | 2/2009 | Stenback | F21V 15/01 362/296.01 |
| 2009/0040750 | A1 * | 2/2009 | Myer | F21S 8/083 362/183 |
| 2011/0210676 | A1 * | 9/2011 | Beghelli | F21V 11/02 315/185 R |
| 2012/0026728 | A1 * | 2/2012 | Lou | F21V 7/005 362/217.05 |
| 2013/0294072 | A1 * | 11/2013 | Miller | F21V 7/00 362/235 |
| 2015/0085476 | A1 * | 3/2015 | Mandy | F21S 8/026 362/147 |

* cited by examiner

SYSTEMS AND METHODS FOR HIGH BAY LIGHT FIXTURES

CROSS-REFERENCE TO RELATED APPLICATIONS

This Application claims the benefit of U.S. Provisional Patent Application No. 62/236,022, filed on Oct. 1, 2015, which is incorporated herein by reference in its entirety.

BACKGROUND

Light fixtures, such as those for high bay applications, include light sources secured to enclosures. The light sources may not be easily removable from the enclosure (e.g., secured using a great number of fasteners and/or an adhesive, etc.). In some cases, the light sources are permanently affixed to the light fixture (e.g., welded, etc.). The light sources may contain various lighting elements (e.g., light-emitting diodes (LEDs), LED chips, metal Halide fixtures, fluorescent elements, etc.), which may be subject to failure during the useful life of the light fixture (i.e., the period during which the light fixture is operational).

SUMMARY

One embodiment of the present disclosure relates to a light fixture including an enclosure and a luminaire module. The enclosure includes a top side and an opposing underside. The luminaire module includes a panel, a plurality of LEDs, a first reflector, and a second reflector. The panel extends along the opposing underside of the enclosure. The plurality of LEDs are coupled to the panel and arranged in the at least one row. The at least one row has a first lateral side and a second lateral side. The first reflector is coupled to the panel and disposed along the first lateral side of the plurality of LEDs. The second reflector is coupled to the panel and disposed along the second lateral side of the plurality of LEDs. The panel is releasably attached to the enclosure such that replacement of the panel simultaneously replaces the plurality of LEDs, the first reflector, and the second reflector.

Another embodiment of the present disclosure relates to a light fixture including an enclosure and a luminaire module. The enclosure is includes a top side and an opposing underside. The luminaire module includes a panel and a plurality of LEDs. The panel extends along the opposing underside of the enclosure. The LEDs are fixed to the panel. The panel is releasably attached to the enclosure such that replacement of the panel simultaneously replaces the plurality of LEDs.

Yet another embodiment of the present disclosure relates to a light fixture including an enclosure and a luminaire module. The enclosure includes a wall. The wall includes a top side and an opposing underside. The luminaire module includes a panel and a plurality of LEDs fixed to the panel. The panel is releasably attached to the enclosure and separated from the opposing underside of the wall by an air gap. The air gap is configured to increase a lumen per watt rating of the light fixture by transferring heat from the plurality of LEDs.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
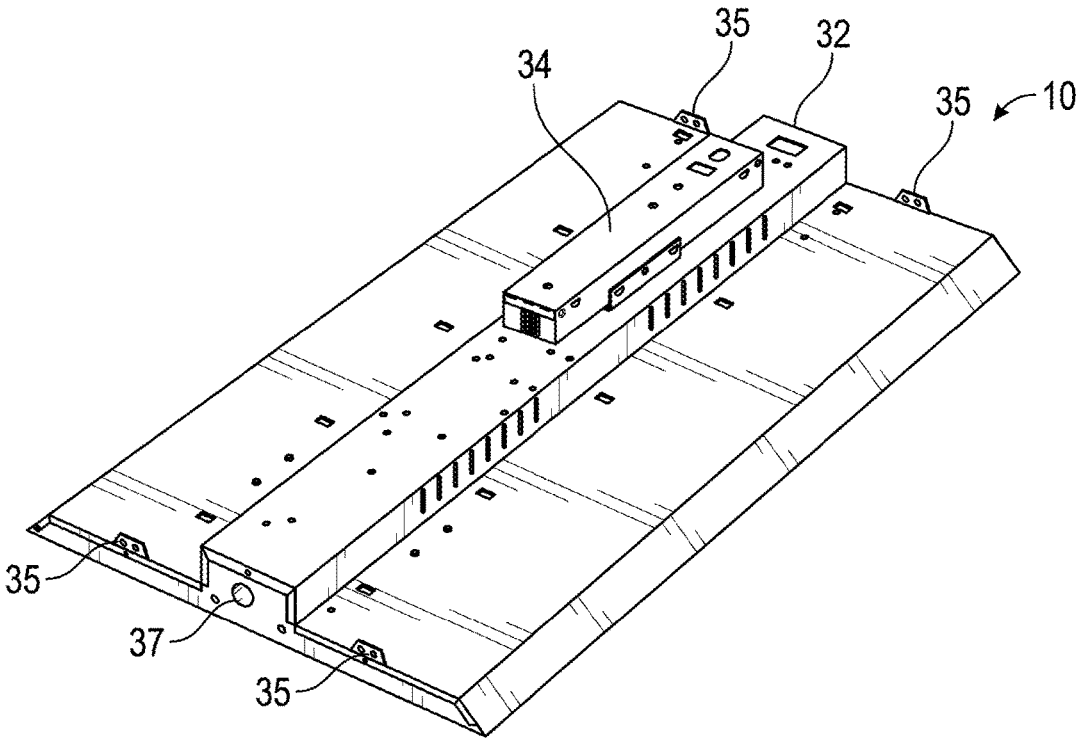
FIG. 1 is a top perspective view of a light fixture, according to an exemplary embodiment.
Figure 2:
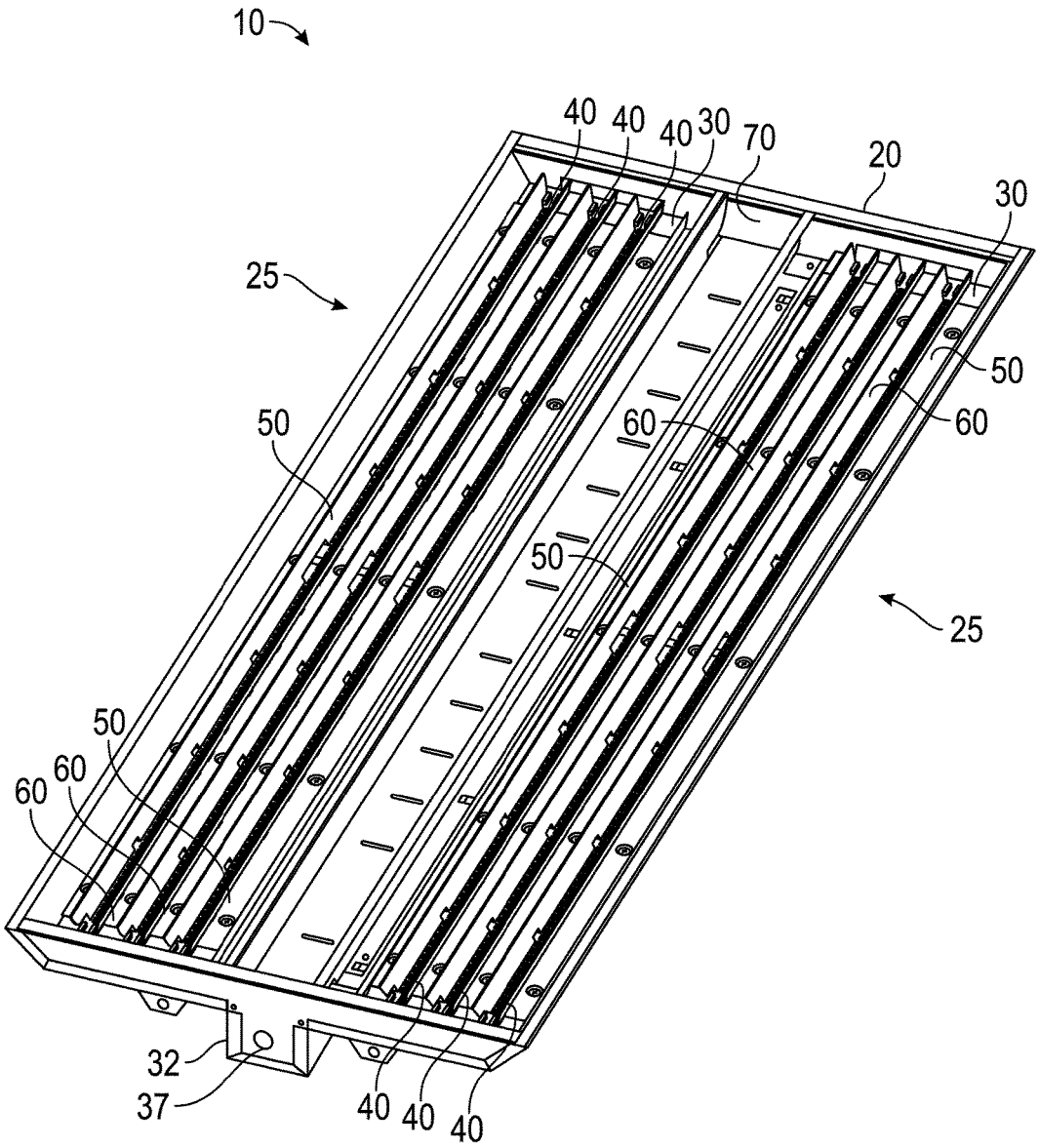
FIG. 2 is a bottom perspective view of a light fixture, such as that shown in FIG. 1, including two light panels, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to FIGS. 1-6, a light fixture, shown as light fixture 10 (e.g., high bay light fixture, lamp, overhead light, etc.), includes a body, shown as enclosure 20, and a number of modules, shown as luminaire modules 25. Each luminaire module 25 may include a panel, shown as panel 30 (e.g., trays, boards, etc.). While light fixture 10 is primary illustrated as a high bay light fixture, it is to be understood that light fixture 10 may be suitable for low bay and other lighting applications as well. Enclosure 20 may be various shapes, sizes, and configurations to accommodate different styles and variations of light fixture 10. Enclosure 20 may have a number of sections. Each section of enclosure 20 may be configured to receive one or more panels 30. Panel 30 may extend along the underside of enclosure 20.

Figure 3:
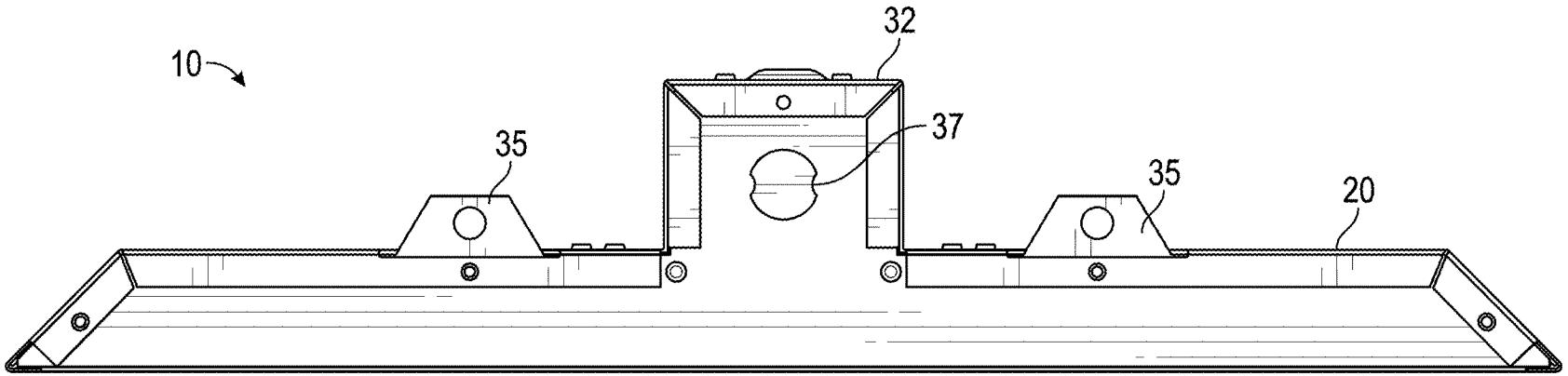
FIG. 3 is a side view of a light fixture, such as that shown in FIG. 1, according to an exemplary embodiment.

As shown in FIG. 1, light fixture 10 includes a channel, shown as channel 32, and flanges, shown as mounting flanges 35. In one embodiment, light fixture 10 includes a driver, shown as driver 34. Driver 34 may be configured to selectively provide electrical energy to light fixture 10. For example, driver 34 may provide electrical energy to lighting elements (e.g., LEDs, etc.) in light fixture 10. In one embodiment, channel 32 is fixed (e.g., welded, riveted, etc.) to enclosure 20. According to an exemplary embodiment, channel 32 is disposed along a longitudinal centerline of enclosure 20. The hardware interfaces may be configured to allow channel 32 to be removably coupled to enclosure 20. According to an exemplary embodiment, the mounting flanges 35 are configured to allow the mounting of light fixture 10 for a given application. For example, mounting flanges 35 may attach to a cable, a chain, or another hanging mechanism which may then be attached to a structure for a particular application. FIG. 3 further illustrates a connecting port 37 (e.g., mate-n-lock, etc.). Connecting port 37 facilitates electrically coupling multiple light fixtures 10 and/or a light fixture 10 to a power source, a controller, or other external component or system. Connecting port 37 may accommodate a plug, thereby facilitating a releasable electrical connection with a power supply and/or with another light fixture 10. Alternatively, light fixture 10 may not include connecting port 37 (e.g., light fixture 10 may instead be hardwired with a wire passing through another aperture, etc.). Enclosure 20 may be of one-piece construction or of multi-piece construction. Portions of enclosure 20 may include reinforcing or additional material to provide structural support or other advantageous properties for a given application. According to an exemplary embodiment, enclosure 20 is a powder coated aluminum structure configured to provide increased thermal management. The aluminum material may facilitate heat transfer away from one or more light sources associated with light fixture 10 and attached to enclosure 20, directly or indirectly (e.g., thereby improving performance and longevity where the one or more light sources are LEDs, etc.).

Luminaire module 25 includes light sources, shown as LEDs 40 (e.g., arrays, light LEDs, boards containing LEDs, etc.). LEDs 40 are coupled (e.g., mounted, disposed, attached, etc.) to panel 30, according to an exemplary embodiment. LEDs 40 may include light-emitting diodes (LEDs), high-powered light-emitted diodes, organic light-emitted diodes, or other suitable light emitting devices, either alone or along with associated circuitry. According to an exemplary embodiment, LEDs 40 are configured to be connected to luminaire module 25 with a hardwired connection. According to various alternative embodiments, LEDs 40 may be coupled to luminaire module 25 with one or more wire-plug connections, one or more removable plug connections, or still another connection. According to various embodiments, the wired connection between LEDs 40 and luminaire module 25 provides an electrical connection. According to various embodiments, LEDs 40 may be configured to be connected to other LEDs 40 either in series or in parallel.

LEDs 40 may be arranged in at least one row, where each row has a first lateral side along the length of the row, and a second lateral side along the length of the row. The length of a row may be longer than the width of a row. In applications where LEDs 40 are arranged into more than one row, the second lateral sides of each row may be disposed adjacent and proximate each other, while the first lateral sides are the lateral sides furthest away from the opposing row. In applications where LEDs 40 are arranged into more than two rows, several rows, termed as middle rows, will have rows disposed on either side. Rather than having a first lateral side and a second lateral side, middle rows simply have symmetric lateral sides. The plurality of rows as a group may have a first lateral side, a second lateral side, and one or more middle regions. According to an exemplary embodiment, LEDs 40 are arranged in two rows and coupled to panel 30. In one embodiment, LEDs 40 are fixed (e.g., permanently attached using an adhesive, a thermal epoxy, a thermal paste, fasteners, etc.) to panel 30. It is to be understood that the term "LED" may refer additionally or alternatively to high-powered light-emitting diodes. Additionally, the types, configurations, colors, beam dispersions, and other properties of LEDs 40 may be adjusted and manipulated. According to an exemplary embodiment, light fixture 10 has a color rendering index (CRI) of 80 at a temperature of four-thousand degrees Kelvin. According to another exemplary embodiment, light fixture 10 has a CRI of 80 at a temperature of five-thousand degrees Kelvin. For example, in some applications, panel 30 may include two LEDs 40, each of different configurations, where the combination of LEDs 40 produces a desired lighting effect for a given application (e.g., one array may produce one color and another array may produce another color that, when blended, produce the desired color or effect, etc.). LEDs 40 may contain any number of individual light elements (e.g., individual LEDs, strips of LEDs, etc.). For example, LEDs 40 may include one, two, three, four, or more strips of LEDs where each strip may include one, two, three, four, or more individual LEDs. Additionally, LEDs 40 may include multiple LED strips, each of different configurations, or may include LED strips which contain a multitude of different individual light elements. For example, LEDs 40 may utilize any number of red-green-blue (RGB) LED strips or individual light elements configured to produce any given color.

As shown in, for example, FIG. 2 and FIGS. 5-7, luminaire modules 25 further include reflectors, shown as first reflectors 50 and second reflectors 60. First reflectors 50 and second reflectors 60 are coupled (e.g., attached, fixed, mounted, etc.) to panel 30. First reflectors 50 may be disposed along the first lateral side of side of rows of LEDs 40. Second reflectors 60 may be disposed along the second lateral side of rows of LEDs 40. According to an exemplary embodiment, LEDs 40 are arranged in at least two rows forming a first lateral side of the at least two rows of LEDs 40, a second lateral side of the at least two rows of LEDs 40, and a number of central regions disposed between rows of LEDs. According to such an exemplary embodiment, first reflector 50 is disposed along the first lateral side of rows of LEDs 40, another first reflector 50 is disposed along the second lateral side of rows of LEDs 40, and at least one second reflector 60 is disposed in the one or more central regions between the rows of LEDs 40.

First reflector 50 includes a wall, shown as first wall 52, and a base, shown as first base 54. According to an exemplary embodiment, first wall 52 of first reflector 50 is angularly offset relative to first base 54 of first reflector 50. According to an exemplary embodiment, the angular offset of first wall 52 of first reflector 50 from first base 54 of first reflector 50 is configured such that first wall 52 of first reflector 50 reflects light from LEDs 40 to a desired location. First base 54 of first reflector 50 may be coupled (e.g., attached, affixed, mounted, fastened etc.) to panel 30. According to an exemplary embodiment, first wall 52 extends laterally outward and away from LEDs 40. According to an exemplary embodiment, first wall 52 includes (e.g., is made from, includes a reflective coating, etc.) a reflective material (e.g., paint, another coating, polished aluminum, polished finish, etc.). The reflective material may be configured to redirect light emitted by LEDs 40. According to an exemplary embodiment, the entire first reflector 50 includes a reflective material configured to redirect light emitted by LEDs 40. According to an exemplary embodiment, first wall 52 includes a reflective material configured to shape a light output from light fixture 10. According to an exemplary embodiment, first wall 52 includes a reflective material configured to redirect light emitted by LEDs 40 and shape a light output from light fixture 10.

According to an exemplary embodiment, second reflector 60 includes a wall, shown as second wall 62, and a base, shown as second base 64. According to an exemplary embodiment, second wall 62 of second reflector 60 is angularly offset relative to second base 64 of second reflector 60. According to an exemplary embodiment, the angular offset of second wall 62 of second reflector 60 from second base 64 of second reflector 60 is configured such that second wall 62 of second reflector 60 reflects light toward a desired location. Second base 64 of second reflector 60 is coupled (e.g., attached, affixed, mounted, etc.) to panel 30. According to an exemplary embodiment, second wall 62 extends laterally outward and away from LEDs 40. According to an exemplary embodiment, second wall 62 extends laterally outward and away from a specific row of LEDs 40. According to an exemplary embodiment, second wall 62 includes a reflective material configured to redirect light emitted by LEDs 40. According to an exemplary embodiment, second reflector 60 includes a reflective material configured to redirect light emitted by LEDs 40. According to an exemplary embodiment, second wall 62 includes a reflective material configured to redirect light emitted by LEDs 40 and shape a light output from light fixture 10. According to an exemplary embodiment, second reflector includes second wall 62, second base 64, and a wall, shown as third wall 66. According to an exemplary embodiment, third wall 66 of second reflector 60 is angularly offset relative to second base 64 of second reflector 60. According to an exemplary embodiment, the angular offset of third wall 66 of second reflector 60 from second base 64 of second reflector 60 is configured such that third wall 66 of second reflector 60 reflects light to a desired location. According to an exemplary embodiment, third wall 66 extends laterally outward and away from LEDs 40. It is to be understood that second wall 62 and third wall 66 are to be used interchangeably, and that there is no distinguishing difference between second wall 62 and third wall 66 other than their structural configuration.

According to an exemplary embodiment, third wall 66 extends laterally outward and away from a specific row of LEDs 40. According to an exemplary embodiment, third wall 66 includes a reflective material configured to redirect light emitted by LEDs 40. According to an exemplary embodiment, third wall 66 includes a reflective material configured to redirect light emitted by LEDs 40 and shape a light output from light fixture 10. According to an exemplary embodiment, second wall 62 and third wall 66 extend laterally inward. According to an exemplary embodiment, second wall 62 and third wall 66 extend laterally inward and away from a pair of the at least two rows of LEDs 40. According to an exemplary embodiment, second wall 62 and third wall 66 extend laterally inward and away from a pair of the at least two rows of LEDs 40 such that second reflector 60 is configured to redirect light emitted by the at least two rows of LEDs 40. According to an exemplary embodiment, second wall 62 and third wall 66 extend laterally inward and away from a pair of the at least two rows of LEDs 40 such that second reflector 60 is configured to redirect light emitted by the a specific row of LEDs 40. According to an exemplary embodiment, second wall 62 and third wall 66 extend laterally inward and away from a pair of the at least two rows of LEDs 40 such that second reflector 60 is configured to redirect light emitted by the a specific number of rows of LEDs 40.

According to an exemplary embodiment, first reflectors 50 include one vertical side. The vertical side of first reflector 50 may have a length longer than the horizontal side of first reflector 50, which is substantially formed at a uniform angle from first reflector 50. According to various embodiments, the vertical side of first reflector 50 is substantially formed at a non-uniform angle from first reflector 50 and has portions substantially formed at one angle from first reflector 50 and other portions substantially formed at a different angle from first reflector 50.

According to an exemplary embodiment, second reflector 60 includes two vertical sides. The vertical sides of second reflector 60 may be substantially parallel along the length of light fixture 10, and have a length longer than the horizontal sides of second reflector 60, which are each substantially formed at a uniform angle from second reflector 60. According to various embodiments, the vertical sides of second reflector 60 are each substantially formed at a non-uniform angle from second reflector 60 and have portions substantially formed at one angle from second reflector 60 and other portions substantially formed at a different angle from second reflector 60.

According to an exemplary embodiment, reflectors 50 and 60 are configured such that the dispersion of light from LEDs 40 may be focused upon a given location. For example, in certain commercial and industrial applications, it may be desirable to have a focused light dispersion along an aisle (e.g., between shelving units, pieces of machinery, etc.). According to one embodiment, light fixture 10 includes two panels 30, each panel 30 including four LEDs 40, two first reflectors 50, and second reflector 60. According to an exemplary embodiment shown in, for example, FIG. 2, FIG. 5, and FIG. 6, light fixture 10 includes two panels 30, each panel 30 including six LEDs 40, two first reflectors 50, and two second reflectors 60.

According to various embodiments, reflectors 50 and 60 define a number of apertures for mounting reflectors 50 and 60 to panels 30. According to various embodiments, LEDs 40 define a number of apertures for mounting LEDs 40 to panels 30. According to various embodiments, reflectors 50 and 60 define a number of apertures (e.g., cut-outs, holes, etc.) disposed adjacent holes in LEDs 40 to permit the manipulation of fasteners in LEDs 40, among other functions. Holes in first reflectors 50, second reflectors 60, or LEDs 40, may be countersunk, or subject to a similar finishing method, such that fasteners are oriented in a desirable orientation for a given application. Additionally, holes in first reflectors 50, second reflectors 60, or LEDs 40, may be threaded, or subject to a similar method, such that fasteners may be secured in desirable manner for a given application.

Figure 4:
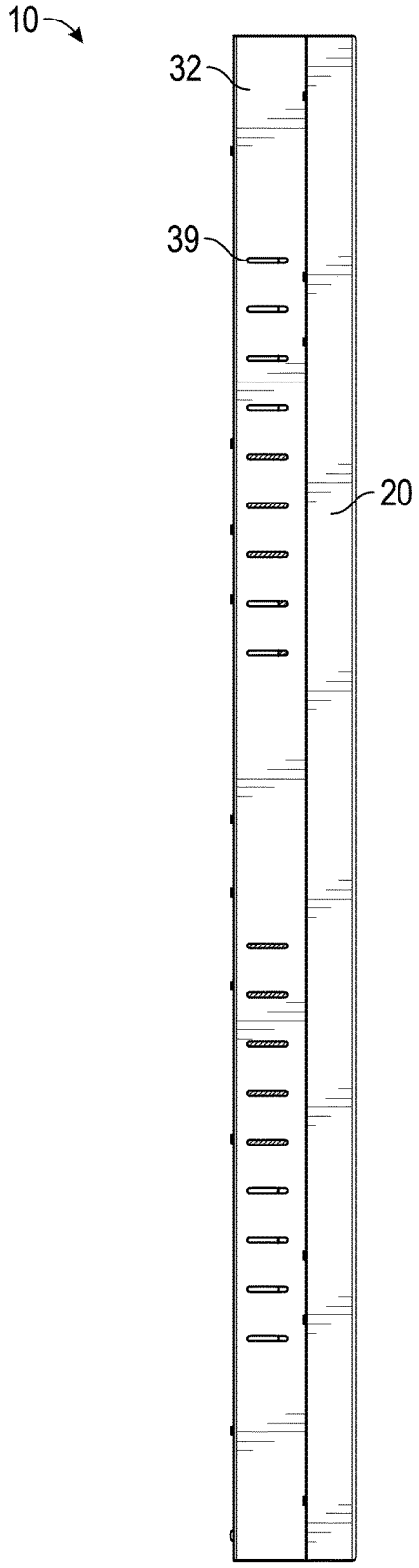
FIG. 4 is a profile view of a light fixture, such as that shown in FIG. 1, according to an exemplary embodiment.
Figure 5:
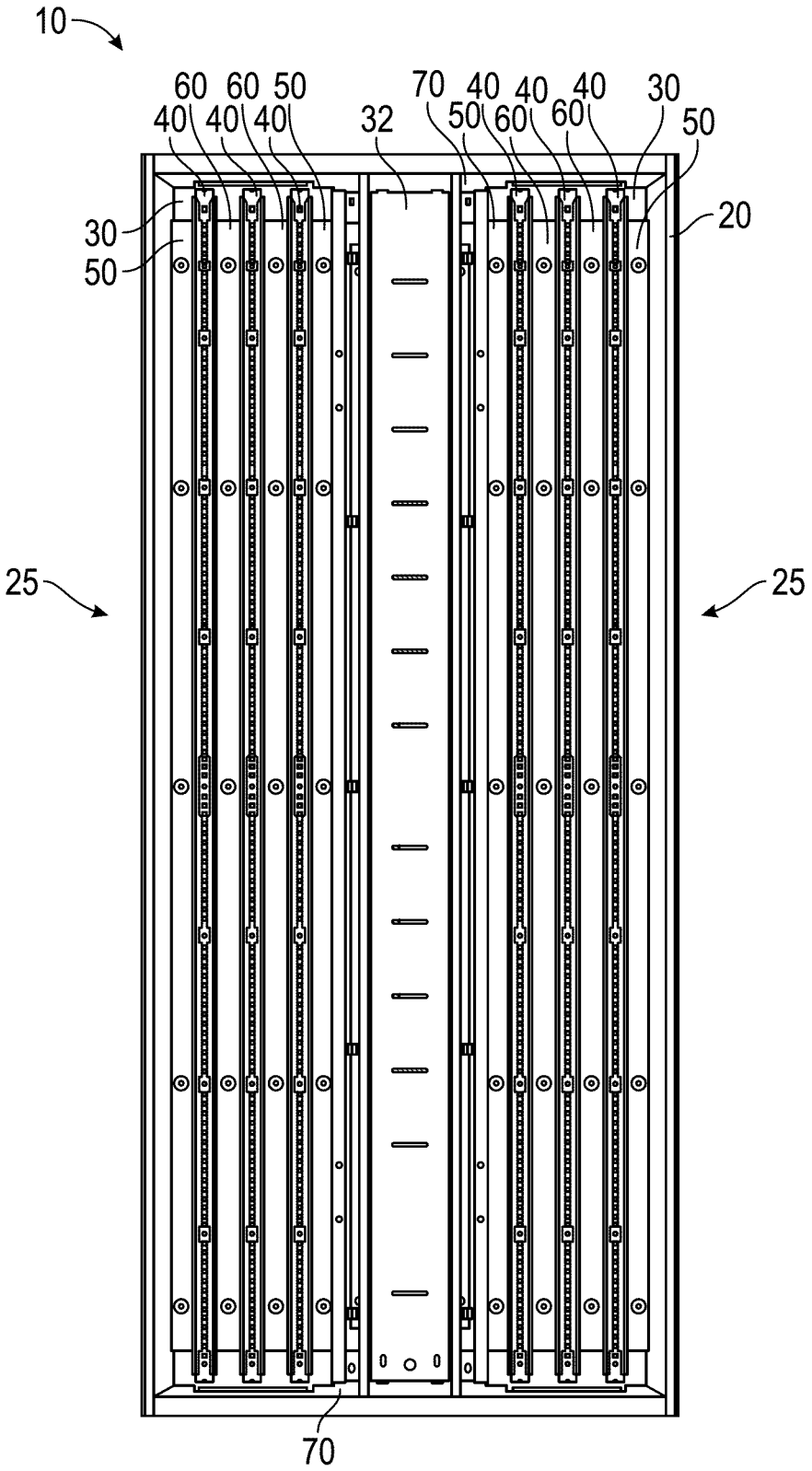
FIG. 5 is a bottom view of a light fixture, such as that shown in FIG. 1, including two light panels, according to an alternative embodiment.
Figure 6:
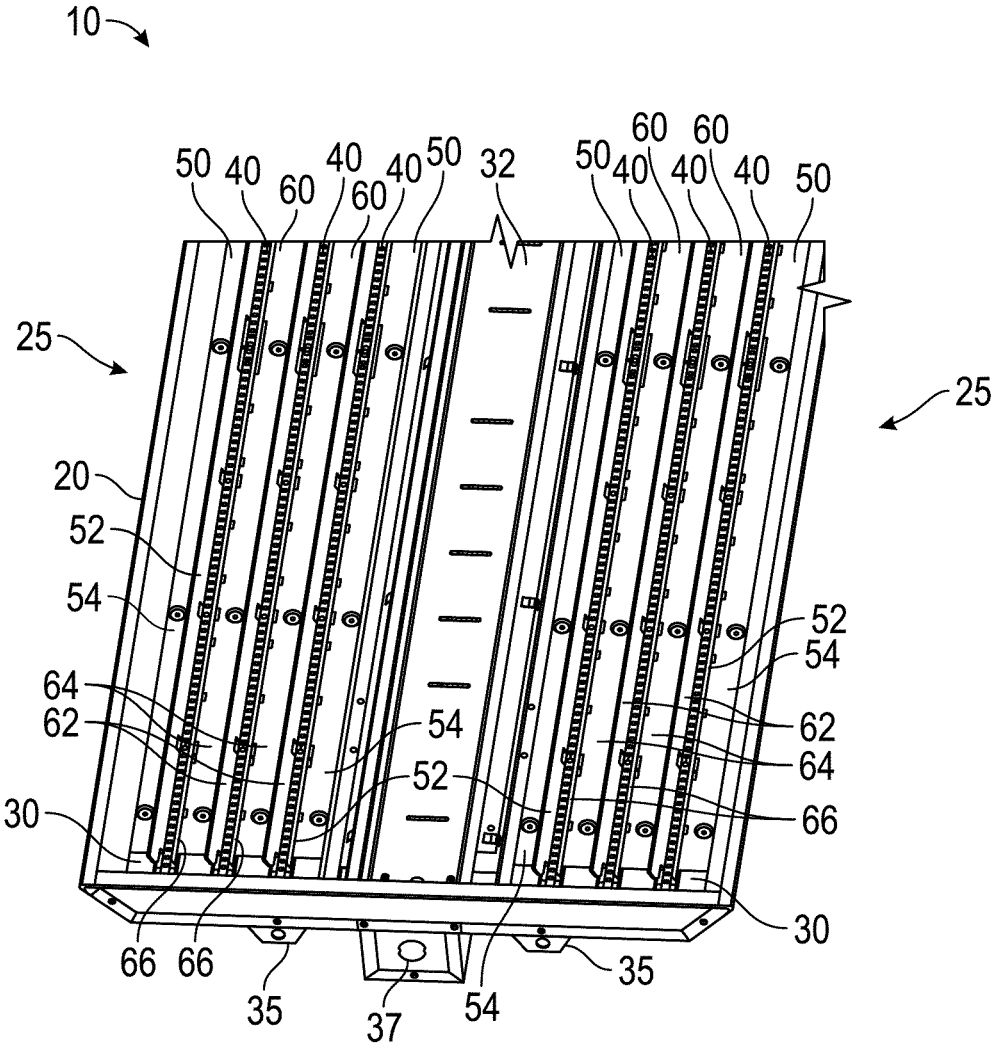
FIG. 6 is a bottom perspective view of a light fixture, such as that shown in FIG. 1, including two light panels, according to an exemplary embodiment.
Figure 7:
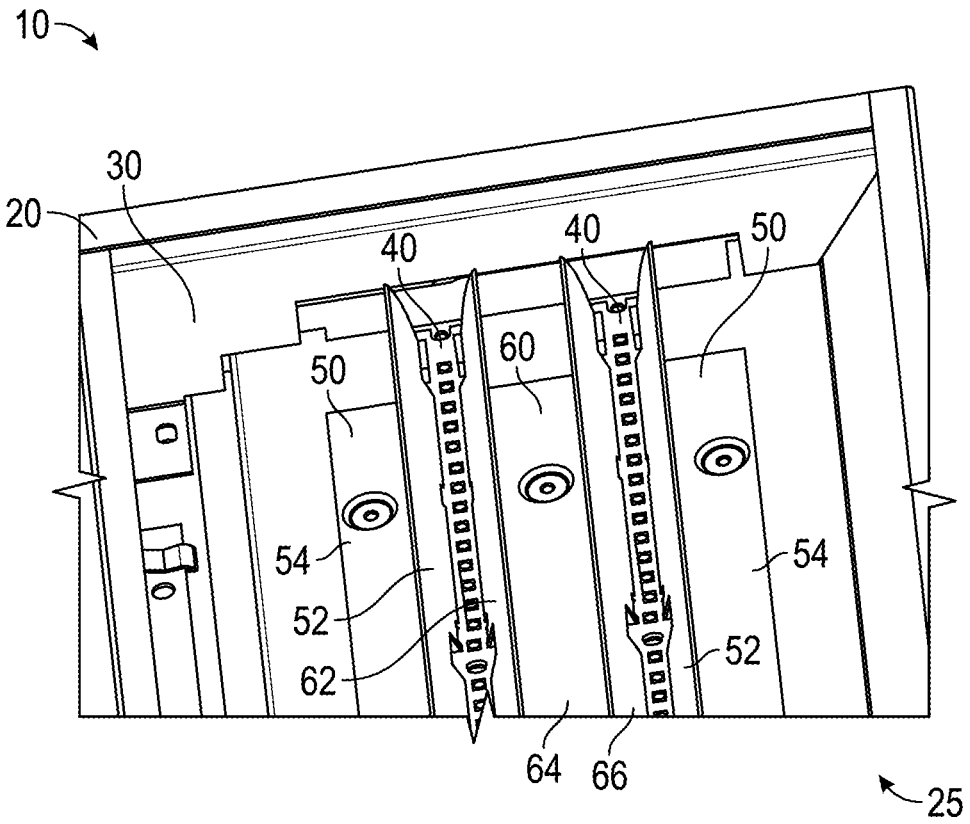
FIG. 7 is a detailed view of a portion of a light fixture, according to an exemplary embodiment.

As shown in FIG. 4, which is a side profile view of light fixture 10 according to an exemplary embodiment, channel 32 includes a number of thermal vents 39. Thermal vents 39 may be of any shape, size, number, or configuration suitable for a given application. Thermal vents 39 facilitate airflow through and into channel 32, thereby improving heat transfer away from light fixture 10.

In some embodiments, light fixture 10 includes two panels 30, each panel 30 including two groups of LEDs 40, for a total of four groups of LEDs 40. As shown in, for example, FIG. 2, FIG. 5, and FIG. 6, light fixture 10 includes two panels 30, each panel 30 including three groups of LEDs 40, for a total of six groups of LEDs 40. According to various exemplary embodiments, each group of LEDs 40 is disposed co-linear with another group of LEDs 40 and disposed such that a connection between each co-linear group of LEDs 40 is established at the centerline of the length, where the length is greater than the width, of light fixture 10. Each group of LEDs 40 is of equal length. In other embodiments, one or more groups of LEDs 40 may have different lengths, and/or may disposed at differing locations on panel 30, including locations that do not render any two groups of LEDs 40 co-linear. For example, light fixture 10 may include groups of LEDs 40 offset a target distance, or placed in a stepped configuration, in order to provide the desired light distribution for a given application. Further, LEDs 40 need not be positioned parallel with an edge of light fixture 10. For example, light fixture 10 may include LEDs 40 in a diamond-shaped configuration in order to provide the desired light distribution for a given application.

Figure 10:
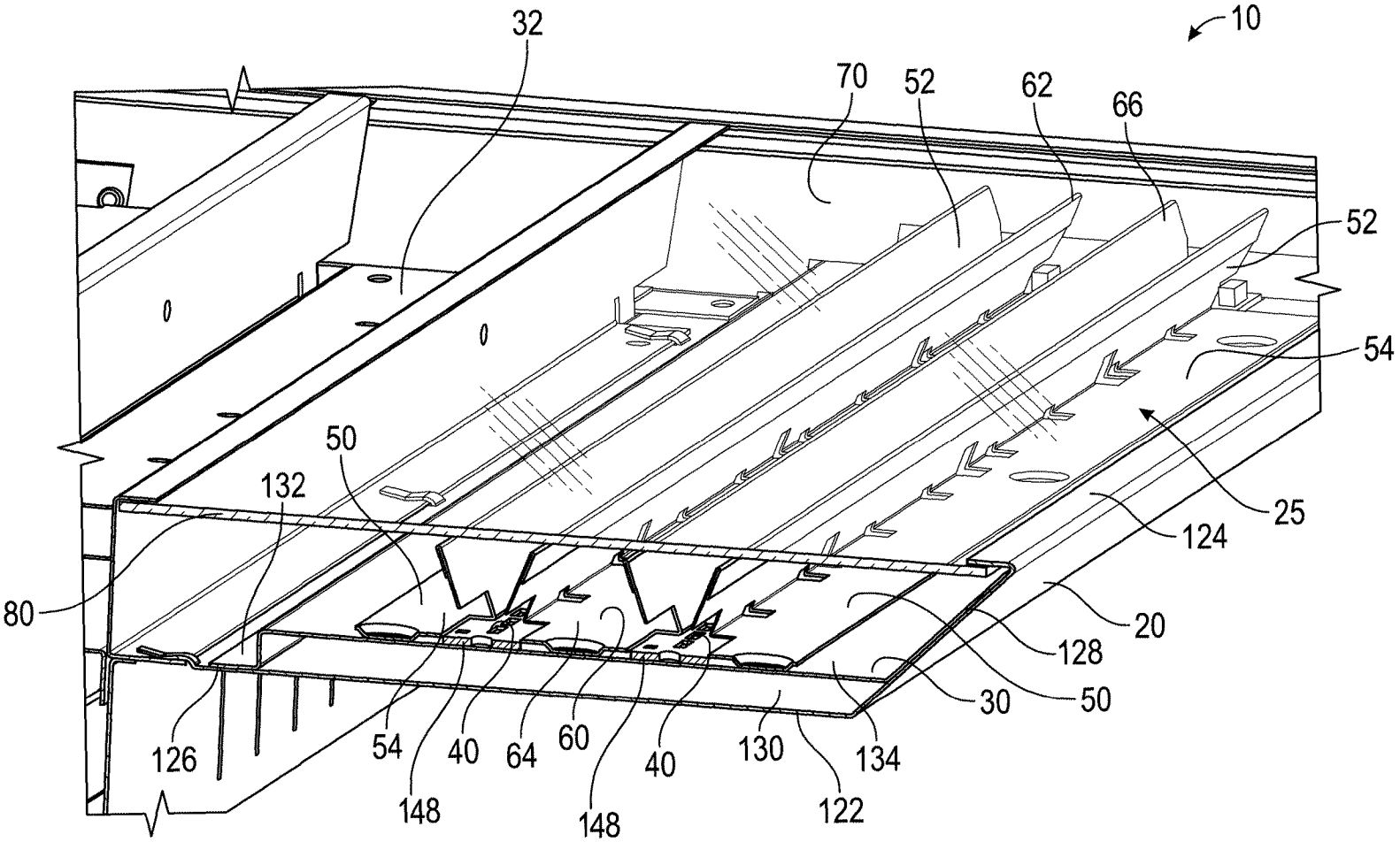
FIG. 10 is a cross-section of a top perspective view of a light fixture, such as that shown in FIG. 9, including two light panels, according to an exemplary embodiment.
Figure 11:
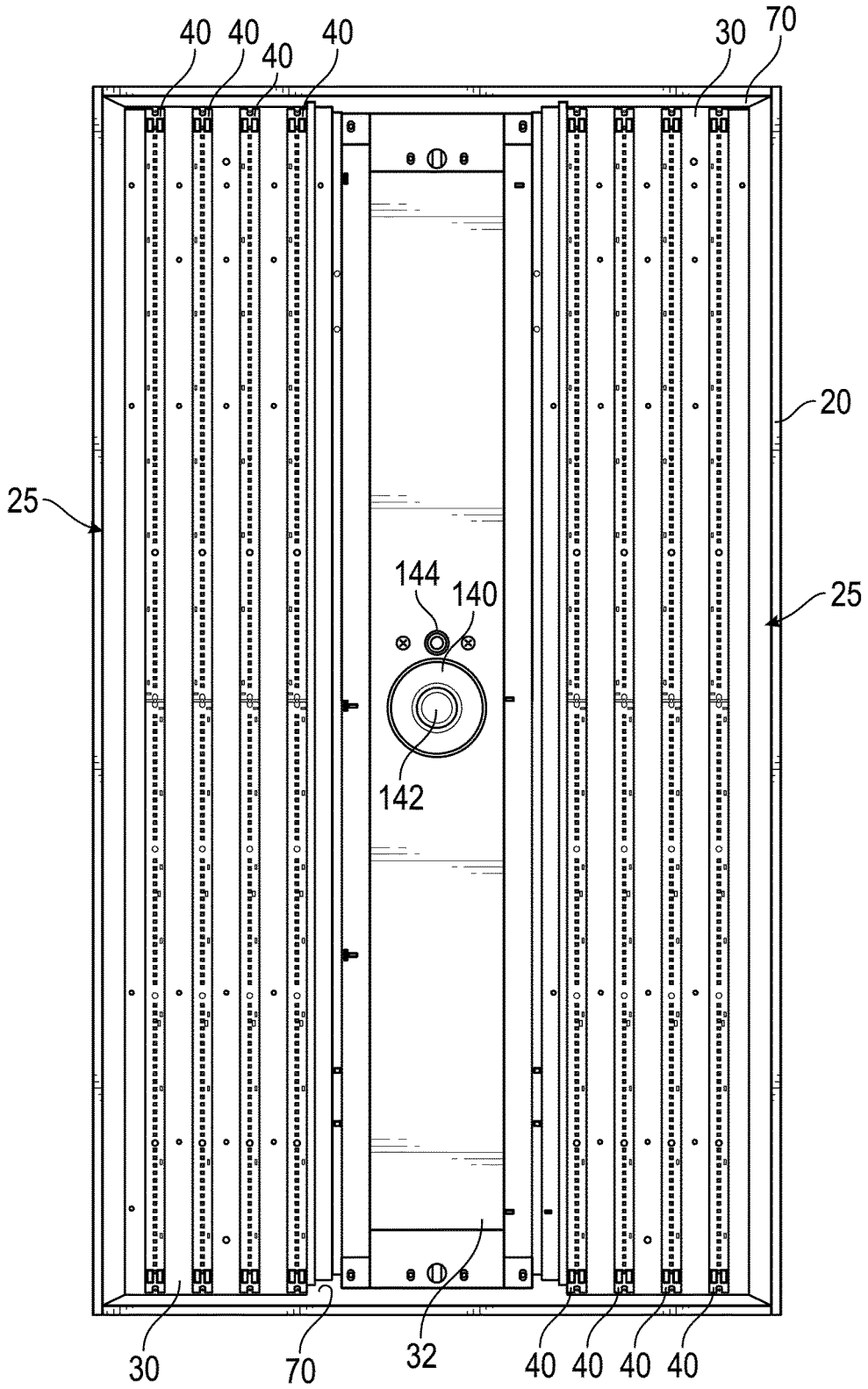
FIG. 11 is a bottom view of a light fixture without reflectors, including two light panels, according to an exemplary embodiment.

According to various embodiments, for example those shown in FIG. 10 and FIG. 11, light fixture 10 further includes deflectors, shown as reflectors 70, attached to enclosure 20. According to an exemplary embodiment, reflectors 70 are configured to have a partially vertical side oriented to substantially mate with the horizontal sides (where the horizontal sides have a length that is smaller than the length of the vertical sides) of reflectors 50 and 60 to provide a surface adjacent the vertical side of reflectors 50 and 60. According to an exemplary embodiment, panel 30 includes reflectors 70 mounted to each horizontal side of enclosure 20. According to another exemplary embodiment, panel 30 includes reflectors 70 mounted to only one-half of a horizontal side or one horizontal side of enclosure. According to an exemplary embodiment, reflectors 70 are configured to focus the dispersion of light emitted from LEDs 40 to a target area.

Through the use of first reflectors 50, second reflectors 60, and reflectors 70, essentially all light emitted from LEDs 40 may be focused to a target area as it is in a traditional light fixture made entirely of or entirely coated with a reflective material. Traditional light fixtures may be a homogenous finish and color (i.e., a reflective color such as white or silver), because they are typically made of a one piece construction. Typically, this one piece construction has a finish or color applied uniformly, meaning that, in order to provide the reflective surfaces needed, the entire light fixture will have a reflective appearance.

An additional challenge faced in typical light fixtures is the need to selectively focus light into certain dispersion areas depending on the application. For example, common light emitting diodes disperse light at one-hundred and twenty degrees resulting in a wide illumination which may not always be effectively lit in an efficient manner. This is particularly at issue in the aisles of commercial and industrial applications where a focused dispersion of light is important. In order to provide this focused dispersion of light, according to an exemplary embodiment, traditional light fixtures may be entirely a light reflective color, material, or finish. According to one example, a traditional light fixture may be entirely coated in white paint. In order to simplify the manufacturing process, and therefore reduce cost of the light fixture, a light fixture is commonly constructed with one finish (e.g., polished aluminum, silver, white, etc.). In certain applications, it may be desirable to have a focused dispersion of light, through the use of reflectors, while having a non-uniform finish disposed on various components of the light fixture.

According to various embodiments, first reflectors 50, second reflectors 60, and reflectors 70 include a reflective material, such as polished aluminum, or are given a reflective coating in a processing step (e.g., painting, coating, etc.). Polished aluminum may be approximately 95% polished aluminum. Through the use of first reflectors 50, second reflectors 60, and reflectors 70, enclosure 20 may be of a non-reflective material finish, color, or may be otherwise processed to have a reflective surface. For example, first reflectors 50, second reflectors 60, and reflectors 70 may be of a highly polished aluminum, while enclosure 20 is finished in a flat black paint. According to various embodiments, the finish of enclosure 20 does not substantially affect the ability of light fixture 10 to focus the dispersion of light emitted from LEDs 40 to a target area. Traditional light fixtures do not allow for one or more components thereof to have finishes other than reflective finishes (e.g., matte or other non-reflective finishes, etc.). By introducing first reflectors 50, second reflectors 60, and reflectors 70, light fixture 10 presents a novel light fixture which may have aesthetically pleasing and unique visual appearance. Enclosure 20 may have a top side and an opposing underside. The top side of enclosure 20 is designed to minimize fastener interference with the finished look of light fixture 10. Additionally, enclosure 20 may have a top side that is of a different color or surface finish than traditional light fixtures. For example, a retail company may have a particular red paint, represented by a hex color code, which provides instant brand recognition among consumers. Rather than being forced to utilize reflective light fixtures, this company may utilize light fixture 10 with enclosure 20 painted, coated, or otherwise processed to match the exact hex color code provided. Certain portions of enclosure 20 may be painted. For example, endcaps of enclosure 20 may be painted orange. According to an exemplary embodiment, panel 30 and enclosure 20 are separate components which are coupled (e.g., attached, affixed, etc.) together. According to an exemplary embodiment, panel 30 has a first coating and enclosure 20 has a second coating. According to an exemplary embodiment, the second coating is different than the first coating (e.g., different in color, different in composition, etc.). According to an exemplary embodiment, panel 30 is a first color, and enclosure 20 is a second color, different than the first color. Panel 30 may thereby reduce the cost of light fixture 10 by obviating the need to coat the entire enclosure 20 with a reflective material.

According to various embodiments, coatings may be adhesive coatings, non-stick polytetrafluoroethylene (PTFE) coatings, release coatings (e.g., silicone-coated release liners), optical coatings, reflective coatings, anti-reflective coatings, ultra-violet (UV) absorbent coatings, tinted coatings, catalytic coatings (e.g., such as those used on self-cleaning glass, etc.), light-sensitive coatings, light-insensitive coatings, protective coatings, anti-scratch-coatings, titanium nitride coatings, anti-corrosion coatings, sealant coatings, plated coatings, electrically conductive coatings (i.e., could be utilized with energy generation or energy recuperation mechanisms within light fixture 10), electrically non-conductive coatings (i.e., could be utilized with energy generation or energy recuperation mechanisms within light fixture 10), inductive coatings, electrically insulating coatings, thermally conductive coatings, thermally insulating coatings, transparent conductive coatings, and other suitable coatings desirable for a particular application. According to various embodiments, color may obtain through the use of a coating, paint, or other suitable color-changing process for a given application.

According to an exemplary embodiment, first reflectors 50, second reflectors 60, and reflectors 70 are configured to focus the dispersion of light emitted from LEDs 40 to a target area. By manipulating the angle of the vertical sides of first reflectors 50, second reflectors 60, and/or reflectors 70, the location and size of the target area may be manipulated. According to an exemplary embodiment, the angle of the vertical sides of first reflectors 50, second reflectors 60, and/or reflectors 70 may be manipulated such that an area does not receive any light emitted from LEDs 40. According to an exemplary embodiment, reflectors 50 and 60 are of a length configured to allow at least a portion of the light emitted from LEDs 40 not to be effected by first reflectors 50 or second reflectors 60. In order to suit different applications (i.e., where light fixture 10 is mounted at different heights, etc.), various first reflectors 50, second reflectors 60, and reflectors 70 may be utilized to meet the need of a desired application. For example, a 10-degree reflector set may be purchased by a user which includes a special first reflectors 50, second reflectors 60, and reflectors 70, designed to for an aisle application at a mounting height of twenty feet.

According to various exemplary embodiments, light fixture 10 includes a sheet, shown as lens 80. According to an exemplary embodiment, lens 80 includes a frosted acrylic material. According to another exemplary embodiment, lens 80 includes a clear polycarbonate. According to yet another exemplary embodiment, light fixture 10 does not include lens 80. Lens 80 may serve to protect light fixture 10 from damage. Lens 80 may also serve to disperse emitted light from LEDs 40, or to change the properties of light emitted from LEDs 40. Lens 80 may include a glare control lens system to enhance low bay operations of light fixture 10. Lens 80 may include a filter (e.g., a separate component, a constituent thereof, etc.) configured to alter a property (e.g., color, etc.) of the light provided by light fixture 10.

Typically, replacing an inoperable light source within a light fixture may be difficult or impossible to achieve without replacing the entire light fixture. For example, the removal of multiple fasteners in various locations, in addition to the disconnecting and subsequent rewiring of a traditional light fixture, may be required to remove a light source from some traditional light fixtures. Additionally, because new and improved LEDs are being developed at an increasingly rapid rate, the LEDs installed in a light fixture upon purchase may become undesirable. For example, a new array may become available which has a substantially higher efficiency than the currently installed array. By utilizing an array with a higher efficiency, a light fixture may operate at a lower cost. Other factors which may impact the value of an array include the output of an array, and the maintenance requirements during the useful life of the light fixture. The useful life of the light fixture may be represented by the number of hours that the light fixture may operate for its intended purpose within a range of allowable parameters. For example, the operable life of may be measured by comparing the current operating efficiency of the light fixture against the rated efficiency of light fixture. In certain applications it may be desirable to have a light fixture that has LEDs which may be easily replaced for repair. In other applications it may be desirable to have a light fixture that has LEDs which may be easily interchanged with a different light source to achieve a desired result (e.g., color, intensity, emission angle, etc.). According to an exemplary embodiment, light fixture 10 has a rated life. According to various embodiments, the rated life of light fixture 10 is not equivalent to the useful life. According to various embodiments, the rated life of light fixture 10 is one-hundred and twenty-five thousand hours. According to an exemplary embodiment, the rated life of light fixture 10 is one-hundred and fifty thousand hours.

In some applications, holes 90 may extend through enclosure 20 and panels 30. According to an exemplary embodiment, panels 30 are secured to enclosure 20 only through the use of fasteners through holes 90. According to various exemplary embodiments, fasteners extend from the bottom (relative to the ground once light fixture 10 has been installed) through enclosure 20, and into extruded material. According to various alternative embodiments, other fastening methods and mechanisms may be utilized such as a nut and bolt, a snap or press fit, a magnetic fit, etc. According to an exemplary embodiment, panel 30 includes LEDs 40, and first reflectors 50, second reflectors 60, and reflectors 70. In application, a component contained within panel 30 may fail or, a user may wish to change the component to an upgraded or different version of the component. In this manner, panel 30 may be considered modular within light fixture 10. According to an exemplary embodiment, a user may simply remove lens 80 from enclosure 20, and then remove the fasteners positioned within holes 90. Once the fasteners in holes 90 are moved, a user may simply rotate panel 30 out from enclosure 20, and unplug any attached wires. A user may, at this time, insert either a replacement light panel, or an upgraded light panel, back into enclosure 20.

Current light fixtures do not offer the flexibility for a user to readily upgrade the light fixture to the newest hardware available (i.e., LEDs). As a result, users of the traditional light fixture must either opt to replace the entire light fixture or to determine the failed component, or component the user wishes to upgrade, replace the component, and rewire that component. Through the use of light fixture 10, a user may upgrade light fixture 10 at very low cost and in very little time. For example, light fixture 10 may include out of date LEDs 40. A user may wish to increase the performance of light fixture 10. By removing panel 30, a user may install upgraded LEDs 40. According to an exemplary embodiment, panel 30 is releasably attached to enclosure 20, through luminaire module 25, through the use of fasteners (e.g., clips, screws, bolts, tool-less fasteners, etc.).

According to an exemplary embodiment, panel 30 is releasably attached to enclosure 20, through luminaire module 25, through the use of at least one of a screw, a twist-lock connector, and a snap-fit connector. According to an exemplary embodiment, panel 30 is releasably attached to enclosure 20, through luminaire module 25, through the use of a combination of a screw, a twist-lock connector, and a snap-fit connector. According to an exemplary embodiment, panel 30 is releasably attached to enclosure 20, through luminaire module 25, through the use of a screw. According to an exemplary embodiment, panel 30 is releasably attached to enclosure 20, through luminaire module 25, through the use of a twist-lock connector. According to an exemplary embodiment, panel 30 is releasably attached to enclosure 20, through luminaire module 25, through the use of a snap-fit connector.

According to an exemplary embodiment, panel 30 is coupled to enclosure 20, through luminaire module 25, through the use of at least one of a screw, a twist-lock connector, and a snap-fit connector. According to an exemplary embodiment, panel 30 is coupled to enclosure 20, through luminaire module 25, through the use of a combination of a screw, a twist-lock connector, and a snap-fit connector. According to an exemplary embodiment, panel 30 is coupled to enclosure 20, through luminaire module 25, through the use of a screw. According to an exemplary embodiment, panel 30 is coupled to enclosure 20, through luminaire module 25, through the use of a twist-lock connector. According to an exemplary embodiment, panel 30 is coupled to enclosure 20, through luminaire module 25, through the use of a snap-fit connector.

According to various exemplary embodiments, a screw may be any suitable screw, such as a slotted screw, a Phillips screw, a hex screw, a square screw, a one-way screw, a Torx screw, a security Torx screw, a polydrive screw, a double hex screw, a triple square screw, a tri-wing screw, a pan screw, a button screw, a round screw, a flat screw, an oval screw, a truss screw, a fillister screw, a cheesehead screw, a wood screw, a machine screw, a sheet metal screw, a high-low screw, a self-tapping screw, a steel screw, a stainless steel screw, a brass screw, an aluminum screw, a nylon screw, a zinc-plated screw, a black oxide screw, a galvanized screw, and a non-stick coated screw.

According to various embodiments, a twist-lock connector may be a threaded connector, an interlocking plug, a male and female interlocking connector, and any other suitable twist-lock connector. According to an exemplary embodiment, a snap-fit connector may be a frictional force interface, a push-to-connect fitting, a push-to-connect connector, a plastic connector, a brass connector, a buckle connector, a clip connector, a clip and slot connector, a snap-fit module, a module feed through connector, a punch down connector, and any other suitable snap-fit connector.

Additionally, a user may opt to remove, install, or change any of LEDs 40, first reflectors 50, second reflectors 60, and reflectors 70 once panel 30 is removed. According to an exemplary embodiment, replacing panel 30 replaces LEDs 40, first reflectors 50, and second reflectors 60. According to an exemplary embodiment, replacing panel 30 replaces LEDs 40. According to an exemplary embodiment, replacing panel 30 replaces first reflectors 50. According to an exemplary embodiment, replacing panel 30 replaces second reflectors 60. According to an exemplary embodiment, replacing panel 30 replaces LEDs 40 and first reflectors 50. According to an exemplary embodiment, replacing panel 30 replaces LEDs 40 and second reflectors 60. According to an exemplary embodiment, replacing panel 30 replaces first reflectors 50 and second reflectors 60.

This may allow for light fixture 10 to be utilized in a variety of different applications within the useful life of the product. For example, a warehouse may purchase light fixture 10 configured for aisle use with fifteen foot ceilings. However, after relocating, the warehouse may want light fixture 10 to be utilized with twenty-five foot ceilings with no aisle use. By removing panel 30, removing first reflectors 50, second reflectors 60, and/or reflectors 70, and installing corresponding first reflectors 50, second reflectors 60, and reflectors 70, light fixture 10 may be retooled for a new application. Alternatively, a different panel 30 could be installed which may have a more desirable distribution for a given application.

According to an exemplary embodiment, LEDs 40 are permanently fixed to panel 30. According to an exemplary embodiment, LEDs 40 are temporarily fixed to panel 30 (i.e., through the use of adhesive, tape, etc.). According to an exemplary embodiment, LEDs 40 and first reflector 50 are permanently fixed to panel 30. According to an exemplary embodiment, LEDs 40 and first reflector 50 are temporarily fixed to panel 30 (i.e., through the use of adhesive, tape, etc.). According to an exemplary embodiment, LEDs 40 and second reflector 60 are permanently fixed to panel 30. According to an exemplary embodiment, LEDs 40 and second reflector 60 are temporarily fixed to panel 30 (i.e., through the use of adhesive, tape, etc.). According to an exemplary embodiment, LEDs 40, first reflector 50, and second reflector 60 are permanently fixed to panel 30. According to an exemplary embodiment, LEDs 40, first reflector 50, and second reflector 60 are temporarily fixed to panel 30 (i.e., through the use of adhesive, tape, etc.). According to an exemplary embodiment first reflector 50 and second reflector 60 are permanently fixed to panel 30. According to an exemplary embodiment first reflector 50 and second reflector 60 are temporarily fixed to panel 30 (i.e., through the use of adhesive, tape, etc.). According to an exemplary embodiment first reflector 50 is permanently fixed to panel 30. According to an exemplary embodiment first reflector 50 is temporarily fixed to panel 30 (i.e., through the use of adhesive, tape, etc.). According to an exemplary embodiment second reflector 60 is permanently fixed to panel 30. According to an exemplary embodiment second reflector 60 is temporarily fixed to panel 30 (i.e., through the use of adhesive, tape, etc.).

According to an exemplary embodiment, LEDs 40 are coupled to panel 30 with a thermally-conductive compound. According to an exemplary embodiment, LEDs 40 and first reflector 50 are coupled to panel 30 with a thermally-conductive compound. According to an exemplary embodiment, LEDs 40, first reflector 50, and second reflector 60 are coupled to panel 30 with a thermally-conductive compound. According to an exemplary embodiment, first reflector 50 and second reflector 60 are coupled to panel 30 with a thermally-conductive compound. According to an exemplary embodiment, first reflector 50 is coupled to panel 30 with a thermally-conductive compound. According to an exemplary embodiment, second reflector 60 is coupled to panel 30 with a thermally-conductive compound. According to an exemplary embodiment, the thermally conductive compound may be a substrate or thermally conductive material such as a foil.

According to an exemplary embodiment, LEDs 40 are coupled to panel 30 with a thermally-insulating compound. According to an exemplary embodiment, LEDs 40 and first reflector 50 are coupled to panel 30 with a thermally-insulating compound. According to an exemplary embodiment, LEDs 40, first reflector 50, and second reflector 60 are coupled to panel 30 with a thermally-insulating compound. According to an exemplary embodiment, first reflector 50 and second reflector 60 are coupled to panel 30 with a thermally-insulating compound. According to an exemplary embodiment, first reflector 50 is coupled to panel 30 with a thermally-insulating compound. According to an exemplary embodiment, second reflector 60 is coupled to panel 30 with a thermally-insulating compound.

According to various exemplary embodiments, a thermally-conductive compound may be resin based, polyurethane based, thermoplastic resin based, polybutylene based, terephthalate based, polyamide based, polyamide-66 based, polyphenylene based, polyphenylene sulfide based, thermally conductive polymer based, flame-retardant polymer based, and other suitable thermally-conductive compounds for a given application.

Figure 8:
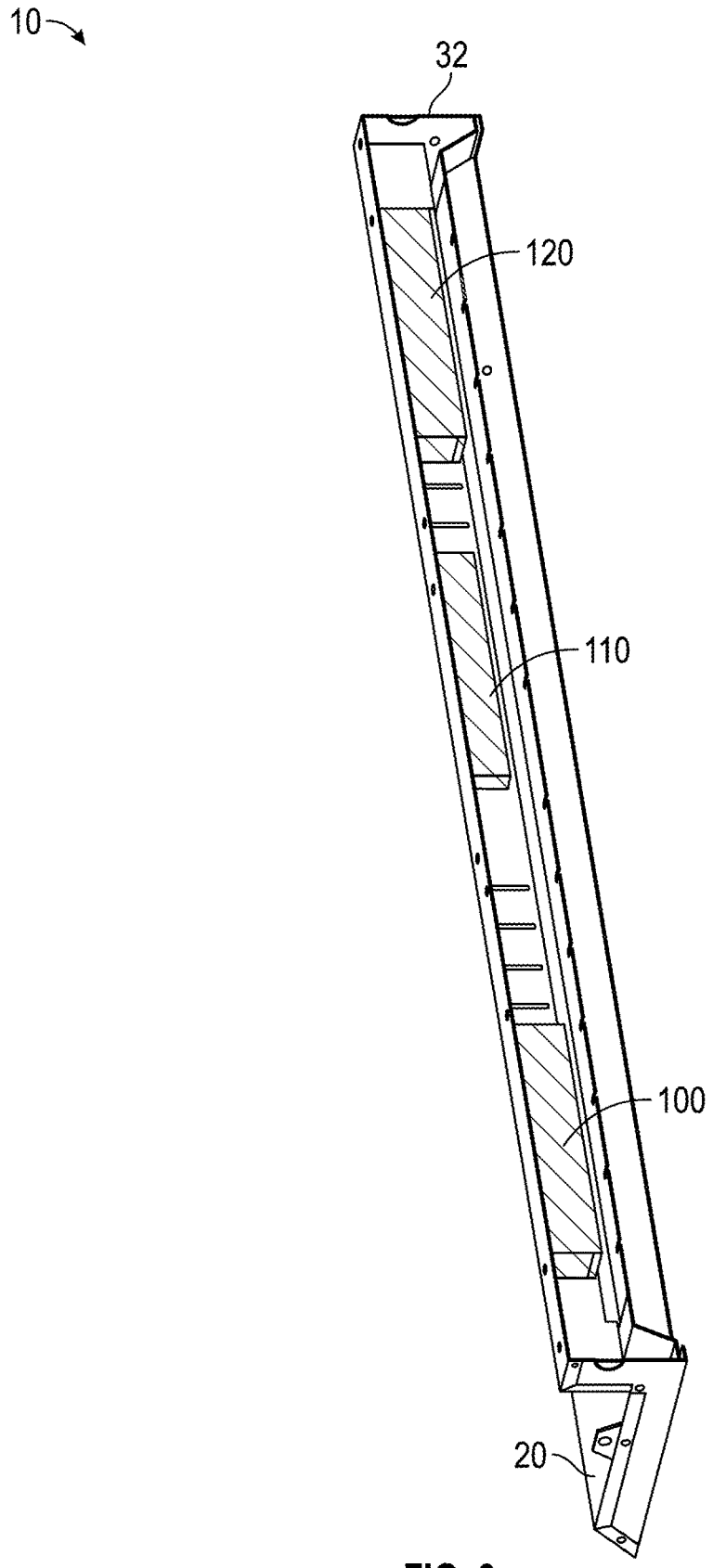
FIG. 8 is a detailed, cross-sectional view of a portion of a central section for a light fixture, such as that shown in FIG. 1, according to an exemplary embodiment.
Figure 9:
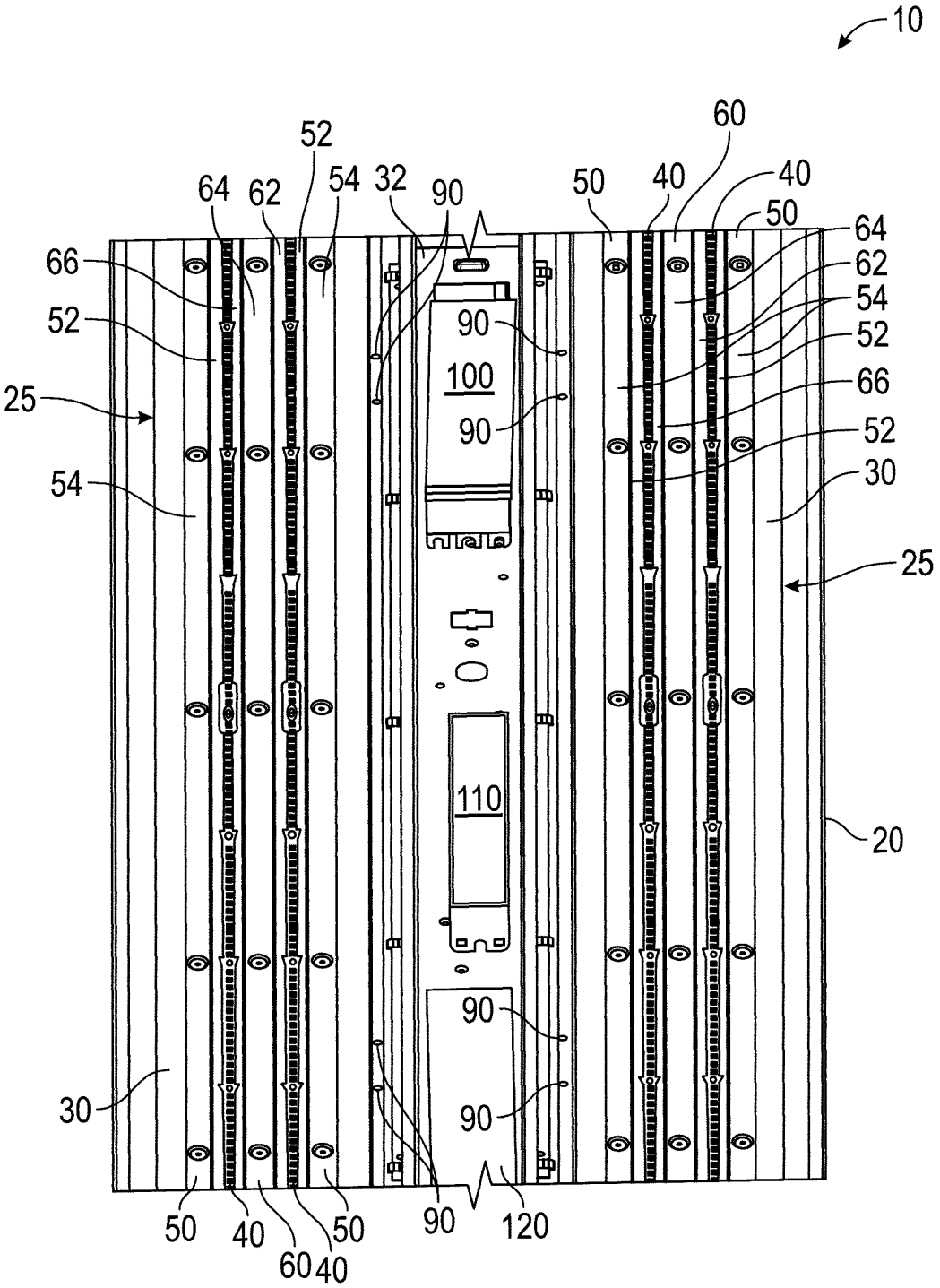
FIG. 9 is a detailed view of a portion of a light fixture, such as that shown in FIG. 7, without a central section, according to an exemplary embodiment.

As shown in FIGS. 8-10, light fixture 10 may further include channel 32. Channel 32 may include a first internal compartment, shown as driver 100, a second internal compartment, shown as module 110, and a third internal compartment, shown as battery 120 (e.g., battery cell, cell, power pack, etc.). According to an exemplary embodiment, driver 100, module 110, and battery 120 are fixed to enclosure 20 and disposed within channel 32. According to an exemplary embodiment, driver 100, module 110, and battery 120 are fixed to channel 32 and disposed within enclosure 20. According to an exemplary embodiment, driver 100 is an LED driver operable to control LEDs 40. According to another exemplary embodiment, driver 100 is an LED driver operable to control LEDs 40 and is a zero to ten Volt dimming driver. According to an exemplary embodiment, module 110 is a sensor designed to monitor any number of parameters such as temperature, light, occupancy, any other similar properties. According to an exemplary embodiment, driver 100 is coupled (e.g., connected, wired to, etc.) to LEDs 40. Driver 100 may operably control LEDs 40 within light fixture 10 to achieve any number of desired parameters as measured by module 110. For example, driver 100 may selectively dim light fixture 10 during periods where module 110 detects that no one is in the area, via an occupancy detector, or driver 100 may selectively dim light fixture 10 in response to ambient lighting conditions as measured by module 110, via a light sensor. According to an exemplary embodiment, module 110 is a sensor for eight foot or less ceiling applications. According to another exemplary embodiment, module 110 is a sensor for twenty foot or less ceiling applications. According to yet another exemplary embodiment, module 110 is a sensor for forty foot or less ceiling applications. According to an exemplary embodiment, battery 120 is a back-up battery designed to power light fixture 10 for a period of time in the event that the main power supply to light fixture 10 is interrupted or lost. Battery 120 may be of any suitable battery configuration such as nickel-metal hydride, lithium-ion, lead-acid, and other suitable battery configurations and chemistries.

As can be seen in various figures, channel 32 is not covered by lens 80, according to various exemplary embodiments. Accordingly, channel 32 may be removed by a user from the bottom of light fixture 10, giving the user direct access to driver 100, module 110, and battery 120. Similarly to panels 30, driver 100, module 110, and battery 120, may be easily upgraded and/or replaced by a user at any given time without the need to replace the entire light fixture. In this manner, driver 100, module 110, and battery 120 may be considered modular with respect to light fixture 10. For example, as technology continues to increase, driver performance will correspondingly increase in terms of overall output, efficiency, and therefore energy savings. Throughout the useful life of light fixture 10 it may be desirable to upgrade driver 100 several times. Similarly, when upgrading panels 30 to light panels with more powerful LEDs 40, it may be necessary to upgrade to a more powerful or capable driver in order to take full advantage of the new light panel. Similarly, throughout the useful life of light fixture 10, battery 120 may need to be replaced, or it may be desirable to upgrade battery 120. Accordingly, a user may upgrade or replace battery 120 to address current application needs. Similarly, module 110 may be upgraded or replaced at any time throughout the useful life of light fixture 10. For example, as new types of sensing and energy generation technologies are developed, it may be desirable for light fixture 10 to have these capabilities. For instance, in the future energy harvesting technologies may allow light fixture 10 to become self-sustaining. In such a situation, it would be possible to incorporate an energy harvesting module within light fixture 10. According to various exemplary embodiments, driver 100, module 110, and battery 120 are configured to be interchangeable by a user without the user of tools. According to various embodiments, module 110 may be utilized to incorporate a second driver or a larger driver 100, and likewise battery 120 may be utilized to incorporate a second or third driver, or a larger driver 100. Likewise, according to an exemplary embodiment, module 110 may be utilized to incorporate a second battery, or to allow for space for a larger battery 120. It is to be understood that driver 100, module 110, and battery 120 are interconnected and interchangeable such that the particular needs of a certain application may be met through a combination of driver 100, module 110, and battery 120.

Yet another challenge faced in typical light fixtures is the tendency of traditional light fixtures to acquire buildup (e.g., dust, soot, debris, etc.) during the useful life of the light fixture. Typically, buildup on the surface of light fixtures negatively impacts the thermal management of the light fixture. Buildup on the surface of the light fixture may alter the characteristics of the surface, such as the color, finish, surface roughness, thickness, thermal conductivity, emissivity, and, in extreme cases, shape and/or size of the light fixture. For example, the heat transfer of energy through radiation from the light fixture to the surrounding environment (e.g., the room, the air, the building, etc.) may be severely decreased due to the changing of surface characteristics such as color, emissivity, finish, surface roughness, shape, and size. Further, the heat transfer of energy through conduction and radiation from the light fixture to the surrounding environment may also be severely decreased due to the changing of surface characteristics such as, thermal conductivity, thickness, shape, and size. In certain applications, it may be desirable to have a light fixture which includes thermal management mitigating features to compensate for the negative thermal impact of buildup throughout the useful life of the light fixture.

Referring to FIG. 10, a cross-section of light fixture 10 is shown, according to an exemplary embodiment. According to an exemplary embodiment, enclosure 20 may include a wall, shown as wall 122 and flange, shown as flange 124. According to an exemplary embodiment, a first edge, shown as edge 126, of panel 30 is coupled to wall 122, and a second edge, shown as edge 128, of panel 30 is coupled to flange 124. According to an exemplary embodiment, flange 124 defines at least a portion of a groove. According to an exemplary embodiment, flange 124 defines at least a portion of a groove which is configured to receive edge 128 of panel 30. According to an exemplary embodiment, edge 128 of panel 30 is fastened to enclosure 20.

As shown in FIG. 10, light fixture 10 includes gap, shown as air gap 130. According to an exemplary embodiment, panel 30 includes a surface, shown as first portion 132, coupled to enclosure 20, and a surface, shown as second portion 134, spaced a distance from enclosure 20. According to an exemplary embodiment, first portion 132 is coupled directly to wall 122 of enclosure 20. According to an exemplary embodiment, air gap 130 is provided between enclosure 20 and panel 30. According to an exemplary embodiment, LEDs 40 are fixed to a face of panel 30 opposing air gap 130. According to an exemplary embodiment, LEDs 40 are fixed to a face of panel 30 opposing air gap 130 with a circuit board, shown as circuit board 148. According to an exemplary embodiment, circuit board 148 and panel 30 form at least a portion of an energy flow path between LEDs 40 and air gap 130. According to an exemplary embodiment, air gap 130 is exposed to a surrounding environment such that an exchange of air between wall 122 of enclosure 20 and panel 30 facilitates convective heat transfer from LEDs 40. According to an exemplary embodiment, air gap 130 is defined as portion between the face of second portion 134 and enclosure 20. Air gap 130 may provide increased air flow to LEDs 40, leading to increased cooling of LEDs 40. LEDs 40 may operate more efficiently or less efficiently than traditional light fixtures, depending on the particular configuration, materials, thicknesses, and other properties of enclosure 20 and panel 30. According to an exemplary embodiment, air gap 130 is configured to increase a lumen per watt rating of the light fixture by transferring heat from LEDs 40. According to an exemplary embodiment, channel 32 of enclosure 20 may be separated from LEDs 40 by air gap 130 thereby reducing heat transfer from driver 100 to LEDs 40.

The total amount of visible light emitted from a light fixture is typically measured in lumens and the amount of power consumed by a light fixture is typically measured in watts. Typically, the efficiency of a light fixture is measured in lumens per watt while the amount of time the light fixture is operating is measured in burning hours per year. In certain light fixtures, such as high bay light fixtures, efficiency is especially important because the light fixtures are operable for a high number of burning hours per year. For example, it is common for a light fixture to be operable for six-thousand burning hours per year and to consume around four-hundred and fifty watts during that time. In a typical application, such as a warehouse or commercial building, it is common for around five-hundred fixtures to be utilized at such rates. Accordingly, it is of paramount importance that the efficiency of the light fixtures be maximized such that the operating cost of the light fixtures is minimized.

According to various embodiments, air gap 130 provides increased cooling and increased efficiency of LEDs 40 and an overall increase in the lumens per watt of light fixture 10. According to an exemplary embodiment, light fixture 10 produces approximately one-hundred and seventy-nine lumens per Watt. In order to increase air flow, and therefore provide increased cooling capabilities, the profile of panel 30 could be altered to enlarge air gap 130. Enclosure 20 could also be altered to enlarge air gap 130 and provide increased air flow, and therefore increased cooling capabilities.

Figure 12:
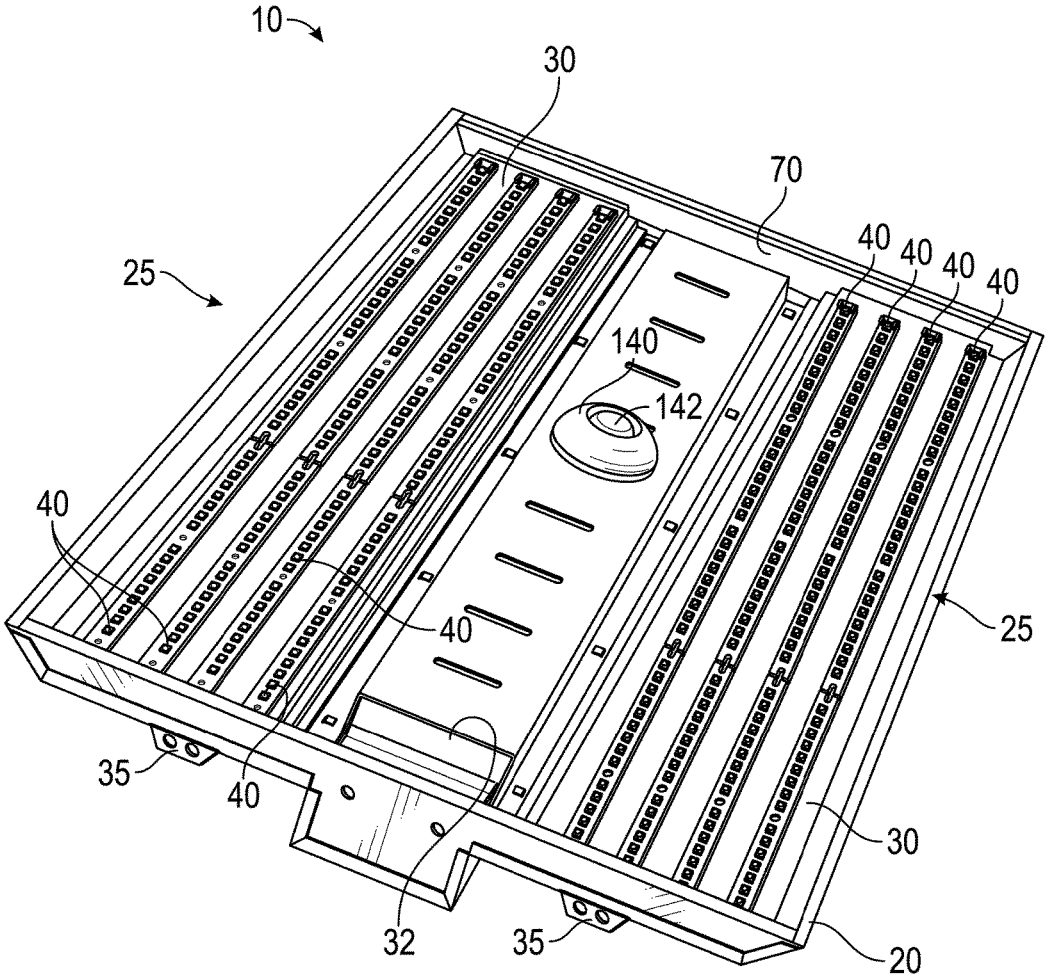
FIG. 12 is a bottom perspective view of a light fixture without reflectors, such as that shown in FIG. 11, including two light panels, according to an exemplary embodiment.
Figure 13:
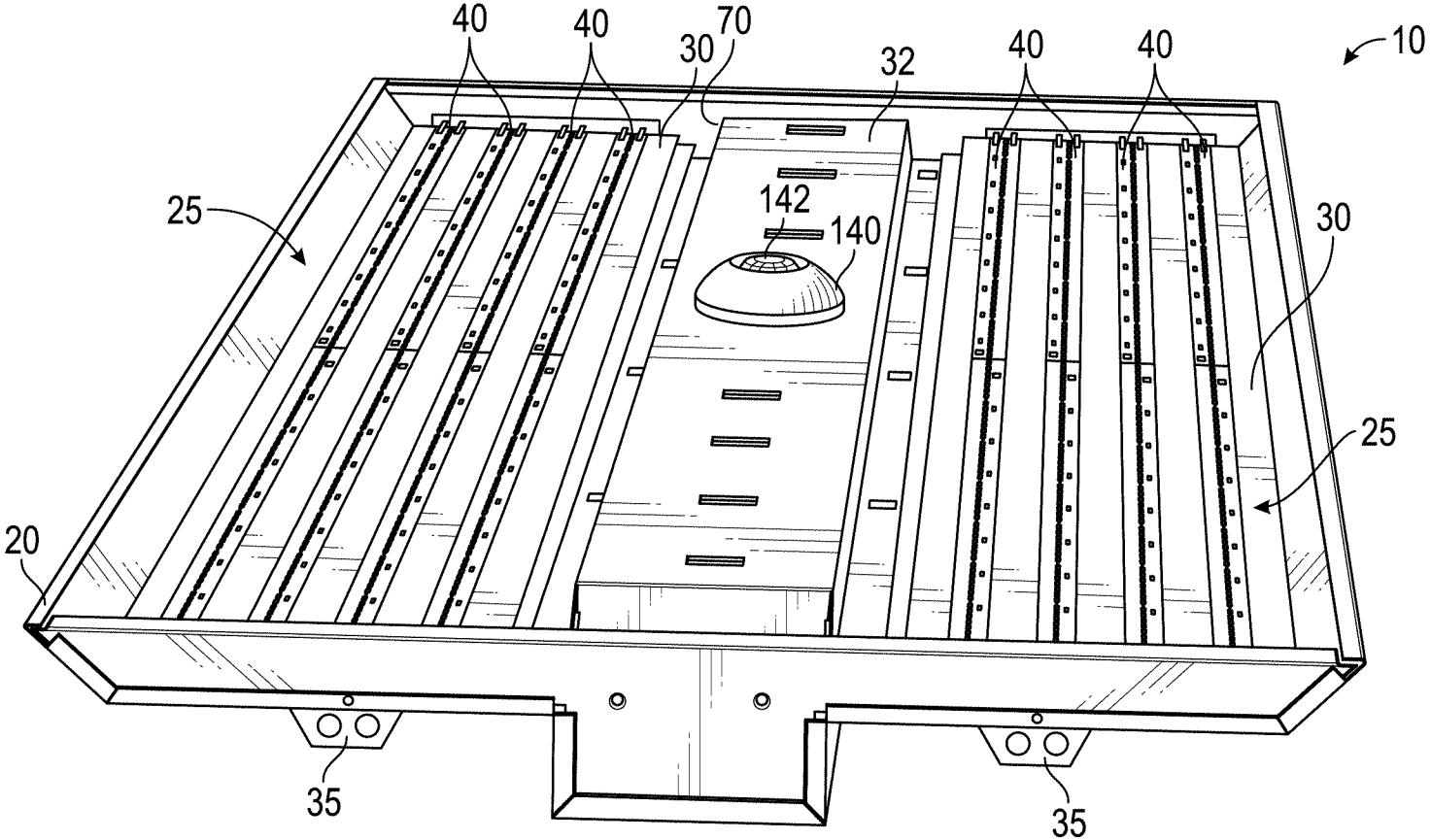
FIG. 13 is a bottom perspective view of a light fixture without reflectors, such as that shown in FIG. 11, including two light panels, according to an exemplary embodiment.

Referring now to FIG. 11 and FIG. 12, a light fixture without first reflectors 50 and second reflectors 60 is shown, according to an exemplary embodiment. With only reflectors 70, dispersion of emitted light is not narrowed, and instead, disperses in a wider area. A light fixture, such as light fixture 10, which does not include first reflectors 50 and second reflectors 60, may be used to cover a wide array with light. In many applications, such as assembly floors, shop floors, maintenance bays, garages, and other applications, it is desirable to have a large coverage of light per light fixture.

As shown in FIG. 11, light fixture 10 includes a protrusion, shown as sensor mount 140, and a sensor, shown as sensor 142, configured to obtain sensor data (e.g., sensor information, measurements, data, readings, etc.). Sensor 142 may be an illumination sensor, an occupancy sensor, a carbon dioxide sensor (e.g., a carbon dioxide sensor used to determine occupancy of a space, etc.), a motion sensor, a temperature sensor (e.g., thermocouple, etc.), a microphone (e.g., for detecting sound, etc.), an electromagnetic sensor (e.g., for sensing electromagnetic energy, etc.), or any other suitable sensor. Sensor mount 140 may optimally position sensor 142 relative to channel 32. In some embodiments, light fixture does not include sensor mount 140, and sensor 142 is rather directly mounted to channel 32. Alternatively, sensor 142 may be contained within channel 32. In some alternative embodiments, sensor 142 transmits sensed data to an external device. For example, sensor 142 may transmit an illumination level to a mobile device. In another example, an operator may be sent a notification on a mobile device (e.g., pushed a notification that displays on a screen of the mobile device without operator input, etc.) stating that motion is detected by sensor 142. Similarly, an operator may visualize temperature, illumination, occupancy, and other sensor data on a mobile application accessible via a computer, personal device, mobile device, or any other similar device. In an alternative embodiment, the operate controls light fixture 10 in response to the sensed data from sensor 142. In another alternative embodiment, light fixture 10 autonomously adjusts operate of light fixture 10 based on sensed data from sensor 142.

According to an exemplary embodiment, light fixture 10 further includes a button, shown as test button 144. Test button 144 may be utilized by an operator (e.g., technician, maintenance worker, engineer, etc.) to test various functionality of light fixture 10. Test button 144 may include a light or speaker for indicating a status of the functionality. In one embodiment, test button 144 is coupled to battery 120 such that an operator may determine if battery 120 has a target charge level (e.g., voltage, etc.). For example, test button 144 may be connected to battery 120 and to a light, such that, when actuated by an operator, test button 144 causes the light to be illuminated if battery 120 is below a target charge level, indicating that battery 120 should be charged, serviced, or replaced.

According to an exemplary embodiment, driver 100, module 110, and battery 120 are included within channel 32. Further, a large number of holes are shown to be present in panels 30. As previously mentioned and illustrated, various components attach to panel 30 through the use of various fasteners. The number of fasteners immediately accessible to the user may be substantially less than the number in traditional light fixtures. As a result, light fixture 10 may appear much less complicated to the user and more streamlined.

Several holes may be included in LEDs 40, first reflectors 50, and second reflector 60, for securing the components to panel 30. As previously mentioned, multiple types of fasteners could be used for various applications of the present disclosure. In one example, a hole is included at the end of LEDs 40 to secure LEDs 40 to panel 30. As previously mentioned, multiple types of fasteners could be used for various applications of the present disclosure. Light fixture 10 may be formed, in part, according to a diagram which indicates where a metal template would be folded (e.g., bent, deformed, etc.) in order to obtain enclosure 20.

While according to the various embodiments illustrated and described herein, holes 90 are located in a particular position, it is to be understood that holes 90 could be located at any position on panel 30 such that holes 90 provided the only attachment mechanism for panel 30 and light fixture 10. In one embodiment, each array has a set of holes dedicated for fasteners to attach LEDs 40 to panel 30. It can also be seen that each reflector has a set of holes dedicated for attaching first reflectors 50 and/or 60 to panel 30.

While according to the various embodiments illustrated and described herein, holes 90 are located in a particular position, it is to be understood that holes 90 could be located at any position on panel 30 such that holes 90 provided the only attachment mechanism for panel 30 and light fixture 10. In addition, any number or spacing of holes 90 could be used to secure panel 30 to light fixture 10.

In one embodiment, each array has a set of holes dedicated for fasteners to attach LEDs 40 to panel 30. It can also be seen that each reflector has a set of holes dedicated for attaching first reflectors 50 and/or 60 to panel 30. According to an exemplary embodiment, reflector 70 is attached to enclosure 20 and interfaces with LEDs 40, first reflectors 50, and second reflectors 60 at a target angle.

According to an exemplary embodiment, light fixture 10 is well suited to exceed high and low bay illumination requirements for industrial, commercial, and retail application. In another embodiment, light fixture 10 is ideal when seeking feature rich, value oriented energy savings and maintenance reductions solutions. In yet another embodiment, light fixture 10 is well suited to meet high and low bay illumination requirements for industrial, commercial, and retail applications. Light fixture 10 may be ideal when seeking a cost effective solution that will drive energy savings and maintenance reductions over traditional high-intensity discharge (HID) lamps and linear fluorescent high and low bay lighting systems. Light fixture 10 may also offer a high lumen per watt performance, and therefore a high efficiency.

According to an exemplary embodiment, light fixture 10 is underwriters laboratory (UL) damp certified, meaning that light fixture 10 may be used in sheltered outdoor areas that are protected from direct contact with rain, snow, or excessive moisture (such as ocean spray). According to an exemplary embodiment, light fixture 10 is design lights consortium (DLC) qualified. According to various exemplary embodiments, light fixture 10 is available in 120V-227V, 347V, and 480V configurations. According to an exemplary embodiment, light fixture 10 has an ambient temperature operating range of negative thirty degrees Celsius to fifty five degrees Celsius.

According to various exemplary embodiments, a section of enclosure 20 may be configured to receive an expansion module in addition to or in place of a panel 30. According to an exemplary embodiment, the expansion module includes a security camera system. The expansion module may also be used for electrical component storage. Various electrical components such as wires, sensors, and drivers may be stored in the expansion module. The expansion module may also include an auxiliary light source. The auxiliary light source may be manipulated by light fixture 10 (e.g., in a master/slave configuration, etc.). The expansion module may include a back-up battery for powering light fixture 10 or other electrical systems. The expansion module may include an energy generation mechanism. The expansion module may include an energy recuperation mechanism. The expansion module may include a communications platform such as a Wi-Fi card, a Bluetooth dongle, or another suitable communications platform. According to the exemplary embodiment where light fixture 10 includes an expansion module that has a communications platform, a user may communicate directly with light fixture 10 to obtain information from one or more on-board sensors. Additionally or alternatively, a user may communicate directly with light fixture 10 to control light fixture 10. According to the exemplary embodiment where light fixture 10 includes an expansion module that has a communications platform, a user may communicate directly with light fixture 10 to reposition a security camera. According to the exemplary embodiment where light fixture 10 includes an expansion module that has a communications platform, a user may communicate directly with light fixture 10 to reposition an auxiliary light source. In still another embodiment where light fixture 10 includes an expansion module that has a communications platform, a user may communicate directly with light fixture 10 to engage the back-up battery. In yet another embodiment where light fixture 10 includes an expansion module that has a communications platform, a user may communicate directly with light fixture 10 to engage the energy generation mechanism. In still other embodiments, a user may communicate directly with light fixture 10 to engage an energy recuperation mechanism.

According to an exemplary embodiment, enclosure 20 includes two sections. According to an exemplary embodiment, each section includes a panel 30. According to an alternative embodiment, enclosure 20 includes three sections. According to still another alternative embodiment, enclosure 20 includes four sections. In other embodiments, enclosure 20 includes more than four sections. According to an exemplary embodiment, enclosure 20 includes three sections and three panels 30. According to an alternative embodiment, enclosure 20 includes four sections and four panels 30. In other embodiments, enclosure 20 includes more than four sections and more than four sections. According to an exemplary embodiment, light fixture 10 has an equal number of sections and panels 30.

Enclosure 20 may be constructed of any suitable material for various applications of light fixture 10. By way of example, enclosure 20 may be constructed of aluminum, powder coated aluminum, anodized aluminum, stainless steel, galvanized steel, electroplated aluminum, electroplated steel, plastic, polymeric based composite, carbon fiber, resin, PVC, wood, and/or still other materials. According to an exemplary embodiment, enclosure 20 is a powder coated aluminum structure. Alternatively, enclosure 20 may be entirely made of or include a coating of a light-reflective material.

Enclosure 20 may include any number of hardware interfaces such as holes, flanges, pems, mounting flanges, mounting posts, extrusions, extruded posts, etc. The hardware interfaces may be disposed on any surface of enclosure 20. The hardware interfaces may be configured to couple various other components of light fixture 10, such as panels 30, to enclosure 20. The hardware interfaces may be disposed on the inside and/or the outside of enclosure 20 (e.g., relative to the position of one or more light sources that enclosure 20 at least partially surrounds, etc.). The hardware interfaces may be configured to be removable. For example, panel 30 may be coupled to enclosure 20 with removable hardware such as fasteners, screws, etc. The hardware interfaces may be configured to be irremovable.

It is to be understood that the term fastener may include any suitable fastening device, mechanism, or component. Likewise, it is to be understood that the term hole may include any suitable aperture for a corresponding fastening device. According to an exemplary embodiment, fasteners are thread forming screws which are configured to interact with material of light fixture 10 to form threads to secure the fasteners to light fixture 10. According to various exemplary embodiments, fasteners are tool-less fasteners that do not require the use of tools (e.g., a screwdriver, a Torx bit, a drill, a key, etc.) to manipulate.

While not explicitly illustrated in the FIGURES, light fixture 10 may include a six foot power supply (e.g., whip, extension cord, etc.) or an eleven foot power supply, and a straight blade plug or a twist lock plug. Light fixture 10 may be mounted on adjustable Y wire hangers, a nineteen foot aircraft cable, a thirty one foot aircraft cable, a pendent mount, a rigid mount, adjustable wire hangers of various lengths, or any other suitable mounting structure for a given application. Light fixture 10 may include an end mounted motion sensor. According to an exemplary embodiment, light fixture 10 is configured as a "plug-n-play" device through use of the InteLite system which immediate supports "Basic Motion," "Smart Motion", and an "integrated system."

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

What is claimed is:

1. A light fixture, comprising:

an enclosure having a top side and an opposing underside, wherein the enclosure includes a channel defined at least partially by the opposing underside;

a first luminaire module, including:

a first panel extending along the opposing underside of the enclosure and positioned on a first side of the channel;

a first plurality of LEDs coupled to the first panel and arranged in at least two rows, the at least two rows having a first lateral side, a second lateral side, and a central region;

a first reflector coupled to the first panel and disposed along the first lateral side of the at least two rows of LEDs, wherein the first reflector includes a first wall that is angularly offset relative to a first base;

a second reflector coupled to the first panel and disposed in the central region, between the at least two rows of LEDs, wherein the second reflector includes a second wall that is angularly offset relative to a second base and a third wall that is angularly offset relative to the second base, wherein the second wall and the third wall of the second reflector extend laterally inward and away from a pair of the at least two rows of LEDs such that the second reflector is configured to redirect light emitted by at least two rows of the first plurality of LEDs; and a third reflector disposed on the second lateral side of the at least two rows of LEDs, wherein the third reflector includes a fourth wall that is angularly offset relative to a third base, wherein the first wall of the first reflector and the fourth wall of the third reflector extend laterally outward and away from the first plurality of LEDs, wherein the first base, the second base, and the third base of the first reflector, the second reflector, and the third reflector, respectively, are coupled to the first panel, wherein the first wall, the second wall, the third wall, and the fourth wall comprise a reflective material configured to redirect light emitted by the first plurality of LEDs thereby shaping a light output from the light fixture; and a second luminaire module, including:

a second panel extending along the opposing underside of the enclosure and positioned on an opposing second side of the channel; and a second plurality of LEDs coupled to the second panel;

wherein the first panel is releasably attached to the enclosure such that replacement of the first panel simultaneously replaces the first plurality of LEDs, the first reflector, and the second reflector; and wherein the second panel is releasably attached to the enclosure, separate from the first panel, such that replacement of the second panel simultaneously replaces the second plurality of LEDs.

2. The light fixture of claim 1, further comprising a driver coupled to the first plurality of LEDs, wherein the driver is fixed to the enclosure and disposed within the channel.

3. The light fixture of claim 1, wherein the first panel is coupled to the enclosure with at least one of a screw, a twist-lock connector, and a snap-fit connector.

4. The light fixture of claim 1, wherein the first panel and the enclosure comprise separate components coupled together, wherein the first panel comprises a first coating, and wherein the enclosure comprises a second coating different than the first coating.

* * * * *